US005188351A

United States Patent [19]

Gysling

[11] Patent Number: 5,188,351

[45] Date of Patent: Feb. 23, 1993

[54] MULTI-SIZE PAPER CASSETTE HAVING A SHEET SIZE INDICATOR

[75] Inventor: Peter Gysling, Boise, Id.

[73] Assignee: Hewlett-Packard Company, Palo Alto, Calif.

[21] Appl. No.: 771,635

[22] Filed: Oct. 4, 1991

[51] Int. Cl.[5] ..... B65H 1/00

[52] U.S. Cl. ..... 271/171

[58] Field of Search ..... 271/171

[56] References Cited

U.S. PATENT DOCUMENTS

| | | | |
|---|---|---|---|
| 4,579,333 | 4/1986 | Aoki | 271/171 |
| 4,607,834 | 8/1986 | Dastin | 271/171 |
| 4,697,803 | 10/1987 | Kan et al. | 271/171 |
| 4,786,042 | 11/1988 | Stemmle | 271/171 |

FOREIGN PATENT DOCUMENTS

| | | | |
|---|---|---|---|
| 7841 | 1/1981 | Japan | 271/171 |
| 131642 | 8/1982 | Japan | 271/171 |
| 172332 | 9/1984 | Japan | 271/171 |
| 207332 | 11/1984 | Japan | 271/171 |
| 225221 | 9/1990 | Japan | 271/171 |
| 276728 | 11/1990 | Japan | 271/171 |

*Primary Examiner*—Robert P. Olszewski
*Assistant Examiner*—Steven M. Reiss

[57] ABSTRACT

A multi-size paper cassette for a printer, such as an electrophotographic or laser jet printer and having a cassette housing which is adapted to receive a back wall and paper receiving shelf in slidable engagement with housing side walls during paper size adjustment and loading of paper into the cassette. A cammed shaft member having a predefined contoured slot therein is pivotally mounted on one of the upstanding side walls of the cassette housing and has an end face aligned with a plurality of indicia marked openinging in a front wall of the cassette housing. The cammed shaft member is operative to receive a driver pin within its contoured slot, and the driver pin and adjoining paper receiving shelf are driven backward and forward in the cassette during paper size adjustment and paper loading. During this operation, the horiozntal motion of the driver pin in the slot during a paper size setting produces a pivotal rotation of the cammed shaft member and moves the end face thereof vertically to a desired one of the paper size indicia marked openings on the front wall of the cassette. The cassette further includes paper width adjustment member which is mounted in another contoured slot within the paper receiving shelf extending from the movable back wall, and this paper width adjustment member moves perpendicular to the edge of the paper as the shelf slides along the floor of the cassette. In this operation, the adjustment member comes to rest at the correct paper width and corresponding to the correct paper length visual indication on the cassette front wall.

9 Claims, 5 Drawing Sheets

MULTI-SIZE PAPER CASSETTE HAVING A SHEET SIZE INDICATOR

TECHNICAL FIELD

This invention relates generally to paper cassettes for document generating equipment and more particularly to a multi-size paper cassette having automatic paper sensing for sheet fed machines, such as electrophotographic printers.

BACKGROUND ART

In the art of document printing such as in the increasingly popular field of electrophotographic or laser jet printing, the printers have generally been designed to print on a number of different paper sizes. These sizes include legal size (8½ inches × 14 inches), A4 size (8.27 inches × 11.7 inches), letter size (8½ ×11 inches) executive size (7.25 inches × 10.5 inches), and B5 size (7.17 inches × 10.12 inches). Using currently available techniques, it is the practice to use either individual paper cassettes to handle each different paper size or to use a single cassette having a movable partition therein which can be manually adjusted to fit a desired paper size.

The above requirement for separate paper cassettes to fit each paper size is obviously undesirable from the standpoint of cost, paper handling and storage, and the use of paper cassettes having adjustable partitions is also characterized by several distinct disadvantages. These include the requirement that an upstanding partition must first be moved from one location to another; then the paper size indicator must be moved by an operator to the correct size indicia, and thirdly an electrical adjustment must be made between the cassette and printer to properly indicate to the printer which paper size is available in the cassette for printing. All of these latter requirements are time consuming, and they leave open the possibility of operator error and failure to make the above correct manual and electrical connections which would properly indicate the paper size being then available or then being used in the paper cassette.

DISCLOSURE OF INVENTION

The general purpose and principal object of the present invention is to provide a novel alternative approach with respect to the above described prior art and one wherein a paper cassette may be automatically adjusted to fit many different paper sizes, while simultaneously providing both a visual indication to an operator of the selected paper size and also providing an electrical indication to a printer and printer operator of the paper size available within an associated printer.

Another object of this invention is to provide a new and improved paper cassette of the type described in which paper width adjustment control is simultaneously provided with paper length visual indication in response to the same back and forth motion which is associated with the loading of paper into the cassette.

Another object of this invention is to provide a new and improved paper cassette of the type described which is elegantly straightforward in both mechanical design and construction.

Another object of this invention is to provide a new and improved paper cassette of the type described which is reliable in operation and economical to manufacture when considering its requirement for only a minimum number of mechanically moving parts.

To accomplish the above purpose and objects, there has been developed in accordance with the present invention a multi-size paper cassette for a printer or copier, and it includes a floor support member adjacent to upstanding side walls and to a front wall having a plurality of indicia marked openings therein. These members define the outer boundaries of a paper cassette housing which further includes a back wall and an adjoining paper receiving shelf which is slidably received by the floor support member and by the upstanding side walls, and the back wall and adjoining shelf member are connected to an extended arm having a driver pin mounted thereon. A cammed shaft member having a predefined contoured slot therein is pivotally mounted on one of the upstanding side walls and has an end face thereof aligned with the plurality of indicia marked openings in the front wall of the cassette housing. The cammed shaft member is operative to receive the driver pin on the extension arm in the contoured slot, so that horizontal motion of the driver pin by the movement of the extension arm causes the pin to move within the slot. This motion in turn produces a pivotal rotation of the cammed shaft member and moves the end face thereof to a desired one of the indicia marked openings corresponding to the correct paper size being loaded into the paper cassette.

In a preferred embodiment of the invention, the cammed shaft member includes a projecting wiper blade extending from the end face thereof, and this blade is operative to provide the correct electrical indication to the printer of the paper size being loaded into the cassette.

In an alternative embodiment of the invention, there is provided an upstanding paper width adjustment member having a pin extending downwardly from its lower facing surface and into a predefined contoured slot in the paper receiving shelf extension member adjacent to the movable back wall of the cassette. Using this approach, sliding movement of the shelf extension member during loading of paper into the cassette will produce a corresponding correct orthogonal movement of the paper width adjustment member in a directional perpendicular to the edge of the paper.

Thus, among the novel features of this invention include the ability to simultaneously correctly position the paper width adjustment member and the end face of the cammed shaft member to the proper paper length indicia location on the front wall of the cassette as the paper receiving shelf member is moved forward and backward along the floor member of the cassette housing.

The above brief summary of the invention, together with its attendant objects, advantages and other novel features, will become better understood with reference to the following description of the accompanying drawings.

DETAILED DESCRIPTION OF THE DRAWINGS

Figure 1A:
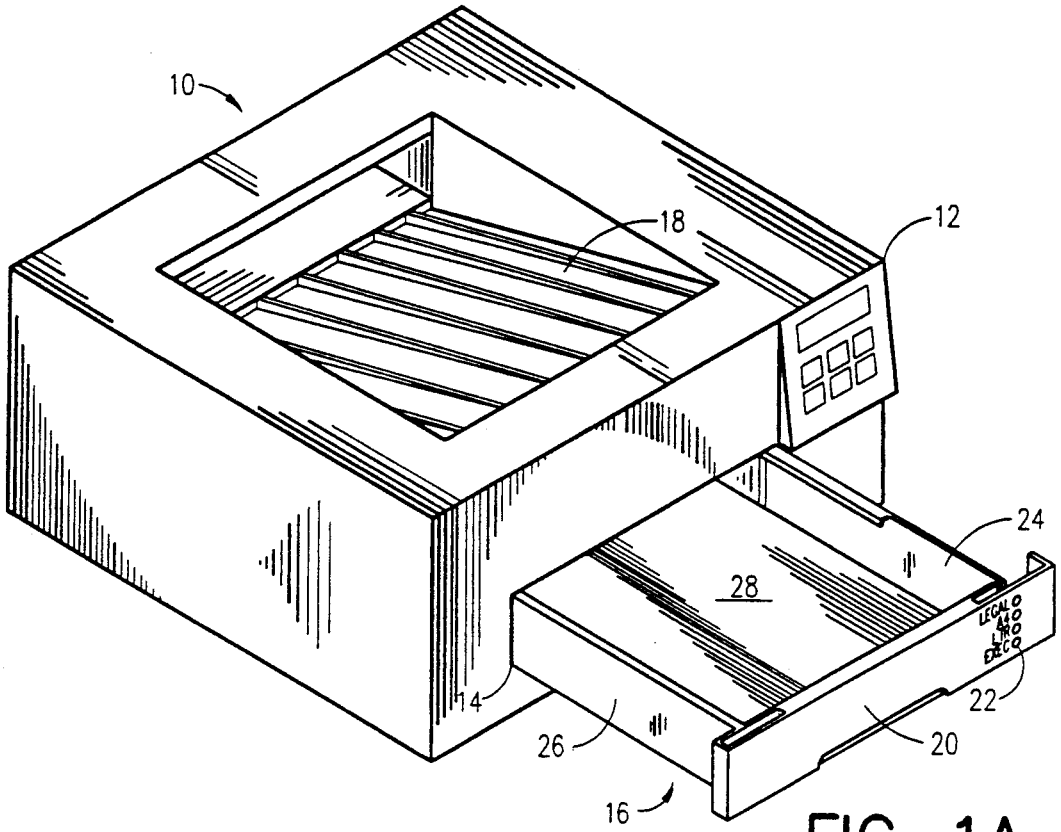
FIG. 1A is an isometric view showing one type of electrophotographic printer in which the present invention and paper cassette embodying same made be used.
Figure 1B:
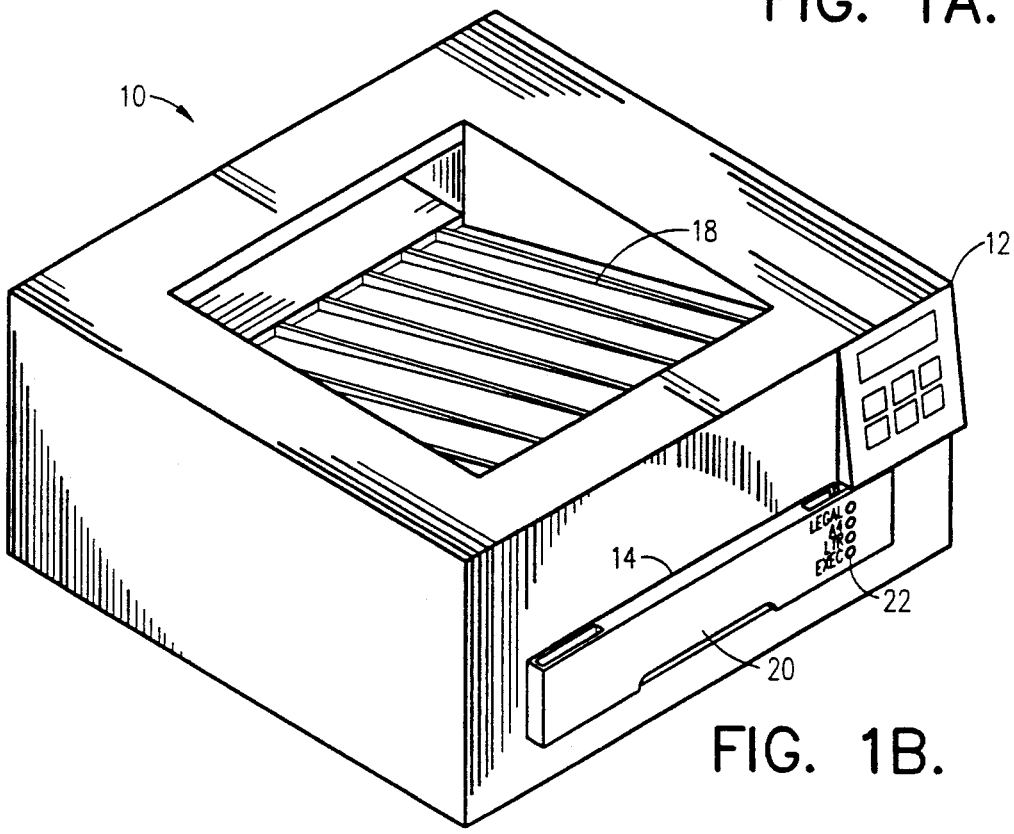
FIG. 1B is a fragmented isometric view showing the paper tray of FIG. 1A in a closed position.

Referring now to FIGS. 1A and 1B, there is shown an electrophotographic printer designated generally as 10, and it includes a main printer housing 12 having an elongated horizontal opening 14 on the front face thereof for receiving a paper cassette 16. The electrophotographic printer 10 will typically include an output paper feed area 18 where printed sheets are normally fed face down for subsequent accumulation. The paper cassette 16 includes a front wall 20 having a plurality of openings 22 therein which serve to provide an indication of paper size as will be described below. The paper cassette 20 further includes a pair of side walls 24 and 26 and a bottom floor member 28 which define the major outer boundaries of the paper cassette housing 16.

Figure 2A:
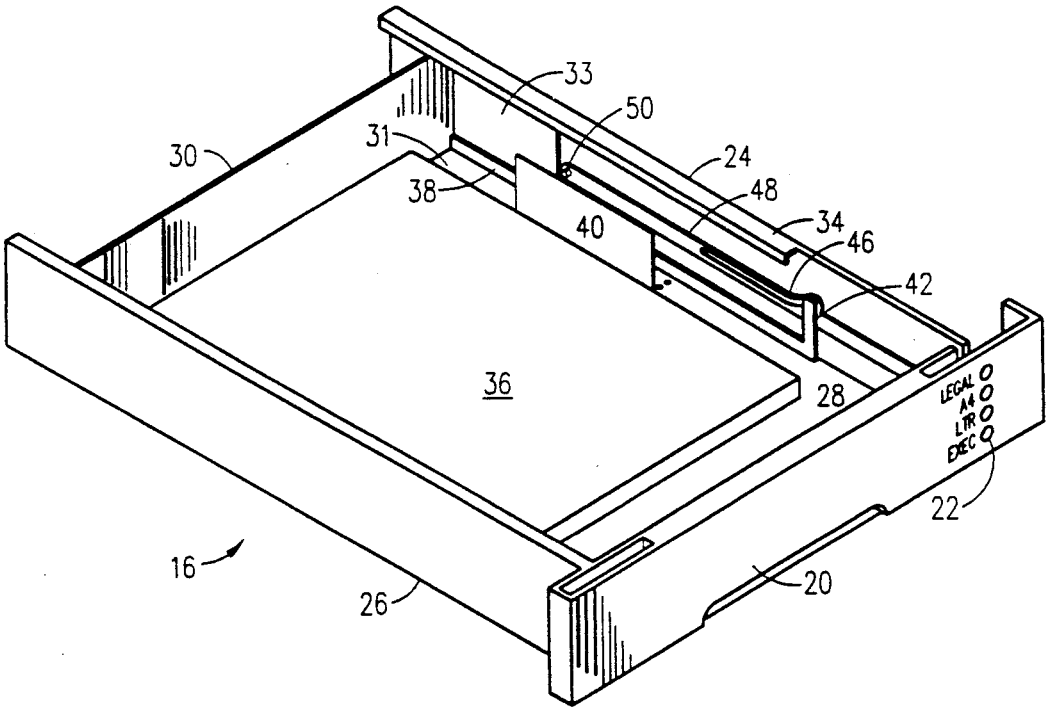
FIG. 2A is an isometric view showing the paper cassette moved to the above described executive position for a relatively short paper length.
Figure 2C:
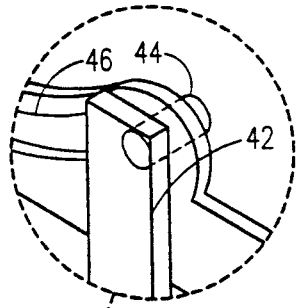
FIG. 2C is an enlarged fragmented isometric view showing the position of the pin 44 in FIG. 2B at the end of the upper angled surface of the contoured slot within the cammed shaft member in FIG. 2B.
Figure 2B:
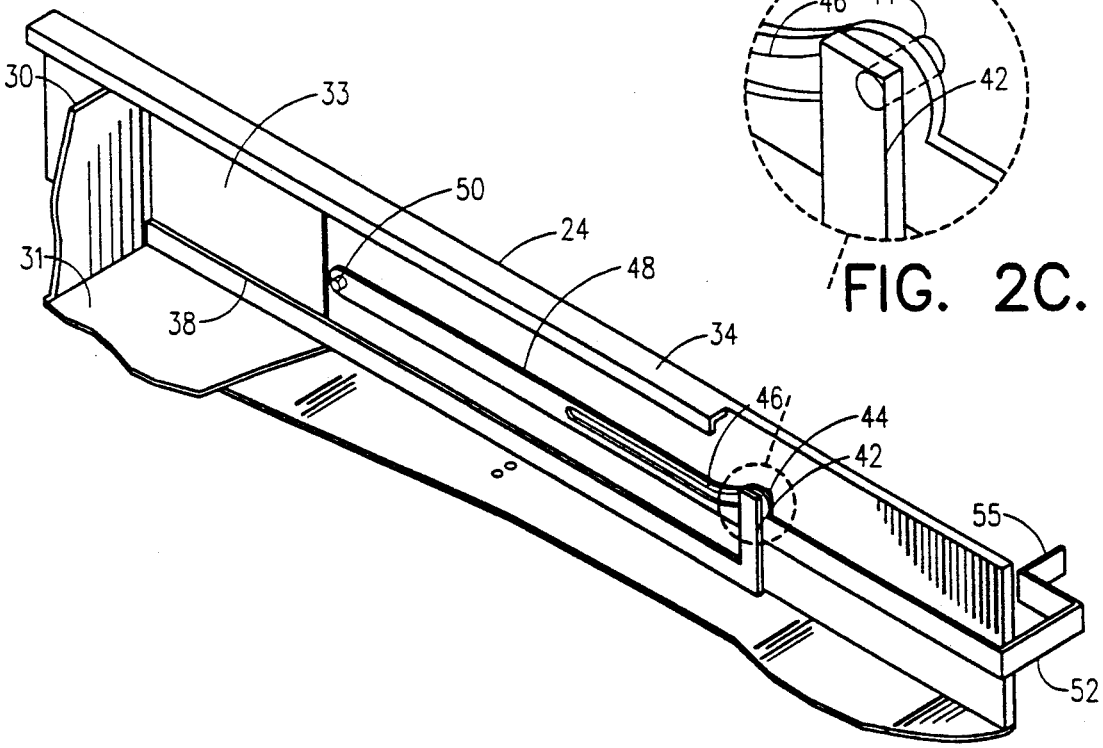
FIG. 2B is an enlarged fragmented isometric view showing the cam action and position of the extension arm for the cassette in FIG. 2A.

Referring now to FIGS. 2A and 2B, the paper cassette 16 further includes an adjustable back wall 30 which is joined to an extended shelf member 31 and extended side wall sections 33 which are slidably engaged by a receiving elongated grooved member 34 extending from the top of the far side wall 24 as viewed in FIG. 2A. The side wall sections 33 are operatively received on the underside of the elongated strip 34 having a groove therein. In the executive size paper position shown in FIGS. 2A and 2B, the side wall sections 33 are moved to their forward-most position with respect to the front wall 20 of the paper cassette, thereby moving a stack of paper 36 also to a forward-most position along the length dimension of the cassette floor member 28.

The far side wall piece 33 as viewed in FIG. 2A has an L-shaped arm 38 fixedly secured thereto, and this arm 38 extends horizontally as shown behind an upstanding paper width adjustment member 40. The arm 38 includes an L-shaped end piece 42 which has a pin extending from the back surface thereof in a configuration shown in more detail in the enlarged fragmented view in FIG. 2B. The pin 44 extending orthogonal to the reverse surface of the L-shaped end piece 42 of the arm 38 is received by an elongated and contoured slot 46 which has been configured in a cammed shaft member 48 in the curved geometry shown. The cammed shaft member 48 is in turn pivotally mounted at a fixed axis of rotation 50 which extends from the upstanding side wall 24 of the cassette. Thus, in operation, when the back wall member 30 is pushed forward in the executive position shown in FIG. 2A, this action causes the L-shaped end member 42 of the extension arm 38 to move forward and upwardly in the slot 46, thereby pushing the end face 52 of the cammed shaft 48 down to its lowermost position corresponding to lower or executive opening within the front wall 20 of the paper cassette.

During the movement of the end face 52 to provide the correct visual indication of paper size at openings 22 on the front wall 20 of the cassette 16, the wiper blade or arm 55 is swept over a series of electrical contacts (not shown) which operate to send an appropriate electrical signal to a connected computer of the size of the paper being loaded into the cassette 16. Thus, using this arrangement the computer operator can receive a visual indication on a computer screen of this paper size now available in the associated printer.

Figure 3A:
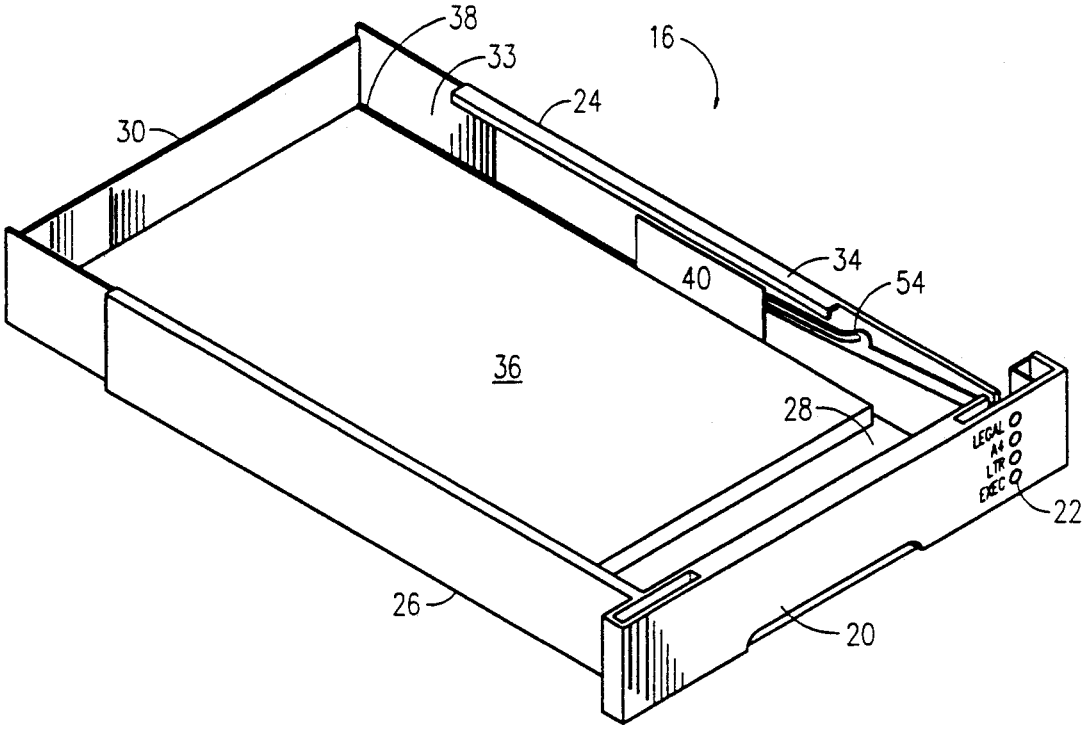
FIG. 3A is an isometric view of the paper cassette moved to its extended position in order to accommodate legal size paper.
Figure 3B:
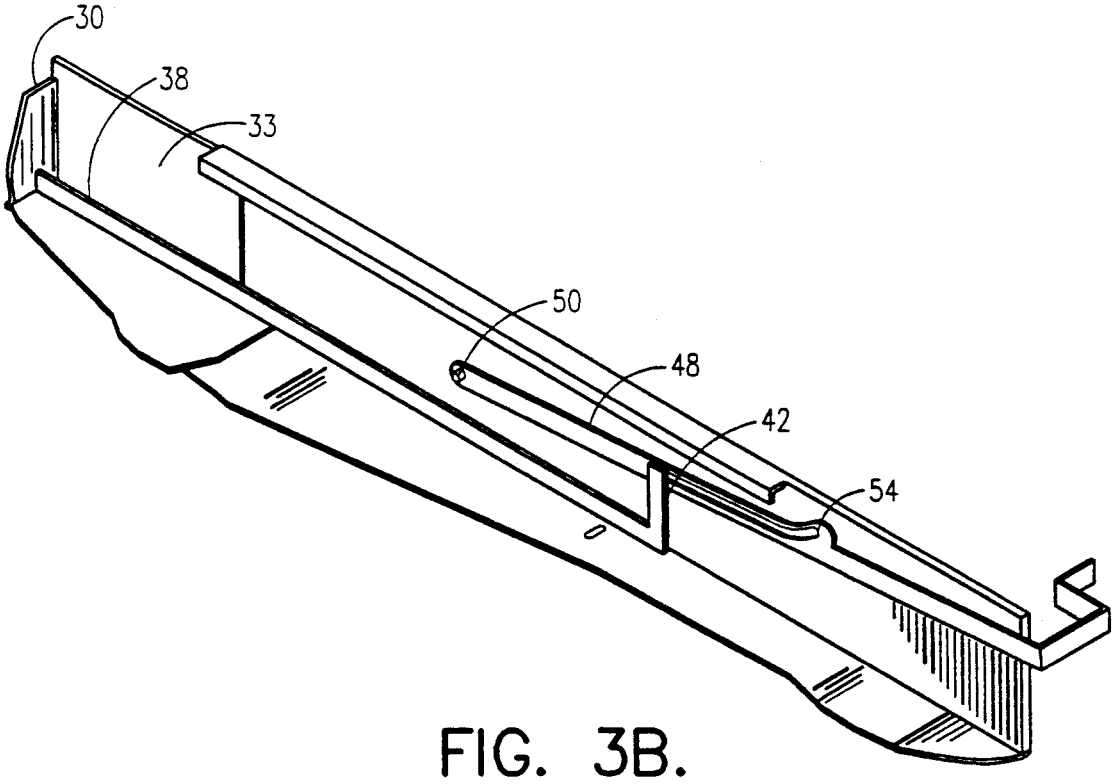
FIG. 3B is an enlarged fragmented isometric view showing the cam action and extension arm position for the cassette shown in FIG. 3A.

Referring now to FIGS. 3A and 3B, when it is desired to adjust the paper cassette 16 to receive legal size paper as indicated in FIG. 2B, the extension arm 38 and side wall section 33 will be retracted within the guide member 34 to its rear-most position as indicated in FIG. 3A, thereby horizontally driving the pin 44 against the upper angled surface 54 of the contoured slot 46. This motion in turn will drive and rotate the cammed shaft 48 counterclockwise to the upper most or legal position indicated on the front wall 20 of the paper cassette and thereby bring the end face 52 of the cammed shaft member 48 in direct alignment with the legal opening shown in FIG. 3A.

Figure 4:
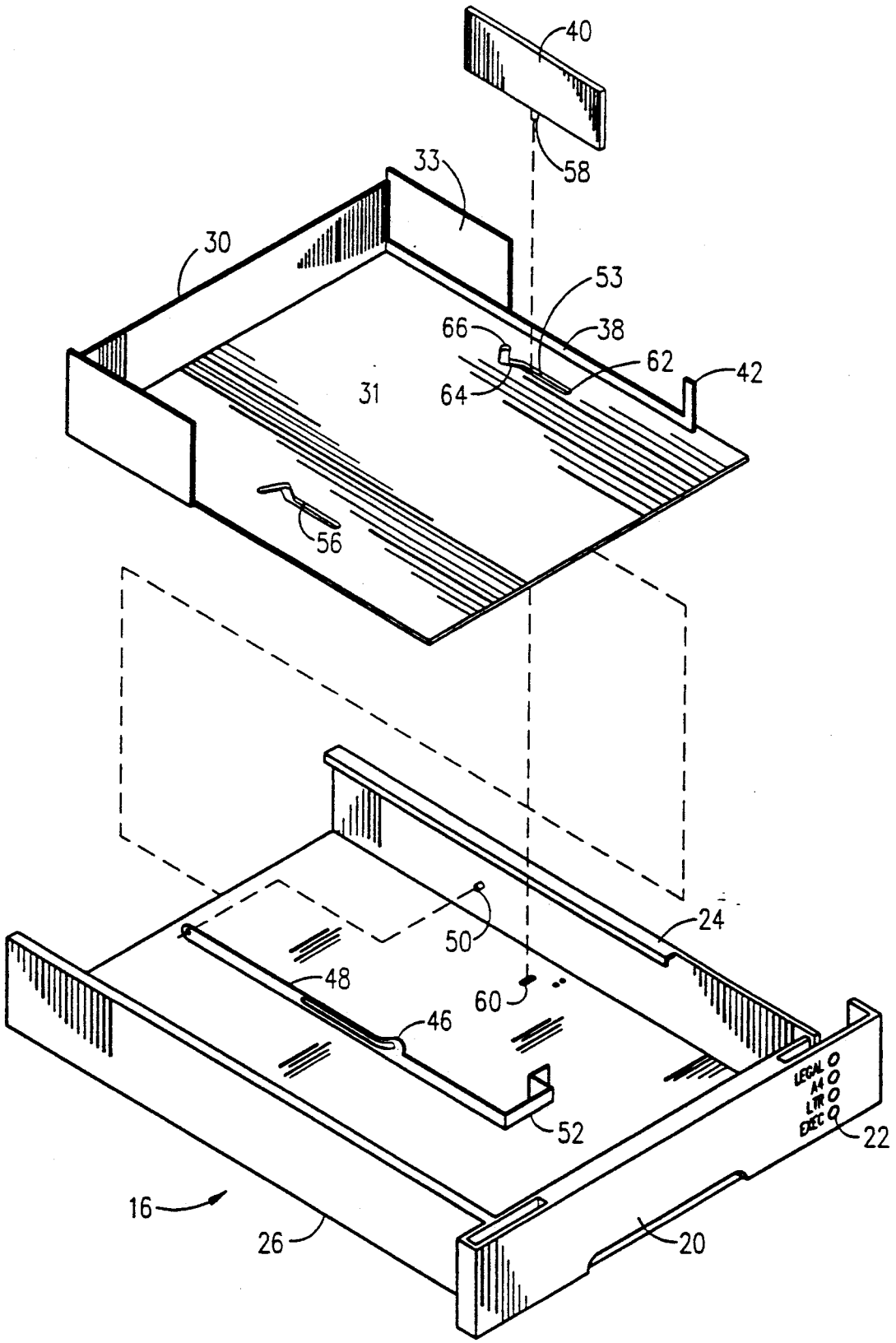
FIG. 4 is an exploded isometric view of the paper tray assembly, particularly for the purpose of showing the alignment and relative positions of the contoured slots in paper tray and movable shelf members which are configured to receive the downwardly facing pin extending from the paper width control member.

Referring now to the exploded view of the paper tray shown in isometric perspective in FIG. 4, the extended shelf member 31 which has been previously described in some detail includes a pair of contoured slots 53 and 56 as shown on each side thereof. These contoured slots 53 and 56 are adapted to receive the downwardly extending pin 58 from the lower surface of the paper width adjustment member 40, and the pin 58 will extend through the slot 53 and into another, orthogonal slot located as shown in the floor member 28 of the paper tray 16.

In operation, when the shelf member 31 is slideably moved along the floor member 28 of the paper tray 16, this motion will move the contoured walls of the slots 53 and 56 against the downwardly extending pins 58 to thereby move the paper width adjustment member 40 to a desired paper width location. It will be understood that only the far side paper width adjustment member 40 has been shown in FIG. 4, and that the near slot 56 will receive a like paper width adjustment member which has been omitted for the sake of brevity.

When the back wall 30 for the paper shelf member 31 has been pulled to its rear-most position to receive 8½ by 14 legal size paper, the slot 53 will be retracted to a position so that the pin 58 is moved toward the right side end 62 of the slot 54 and force the paper width adjustment member 40 to the 8½ inch width dimension corresponding to the 14 inch length dimension for legal size paper. Simultaneously, as previously described, this same motion will retract the L-shaped arm 42 of the shaft 38 to thereby rotate the cammed member 48 upwardly to the legal position noted on the face 20 of the paper tray 16.

Then, as the back wall 30 for the paper receiving shelf member 31 is pushed forward, the pin 58 will move successively through the 8.27 inch, 8½ inch, 7.25 inch, and 7.17 inch width dimensions corresponding, respectively, to the 11.7 inch length dimension for A4 paper, the 11 inch dimension for letter size paper, the 10.5 inch length dimension for executive size paper, and finally and optionally to the 10.12 length dimension for B5 size paper corresponding to the position at point 0.64 on the slot 34 where the paper width adjustment member 40 is drawn into its most narrow paper width position. Then, any further forward movement of the paper containing shelf member 31 in FIG. 4 will operate to draw the pin 58 into the position 66 on the contoured slot 53 to thereby release any edge force on the paper being stacked.

During the above movements, the pin 58 is contained at all times within the orthogonal slot 60 in the floor member 28 of the tray 16 so as to maintain the motion of the paper width adjustment member 40 in a fixed orthogonal direction during this paper width adjustment action.

Figure 5A:
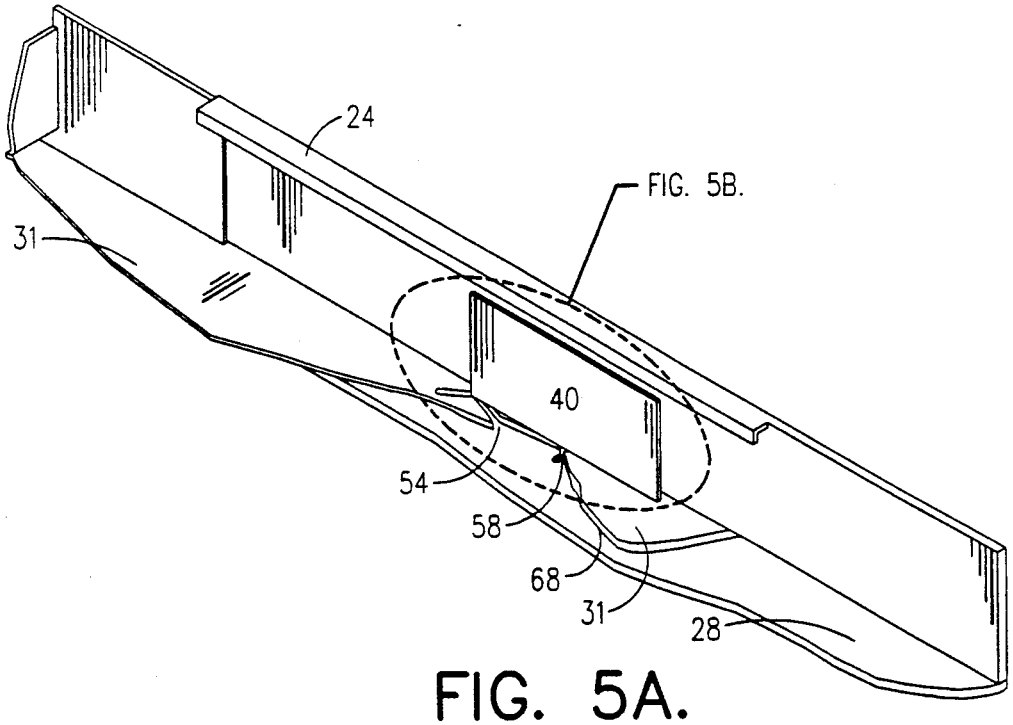
FIGS. 5A and 5B are fragmented isometric views showing the contour of the slot in the shelf extension member cut-away, with the downwardly facing pin of the paper width adjustment member extending therethrough and into the smaller horizontal slot in the floor of the paper tray.
Figure 5B:
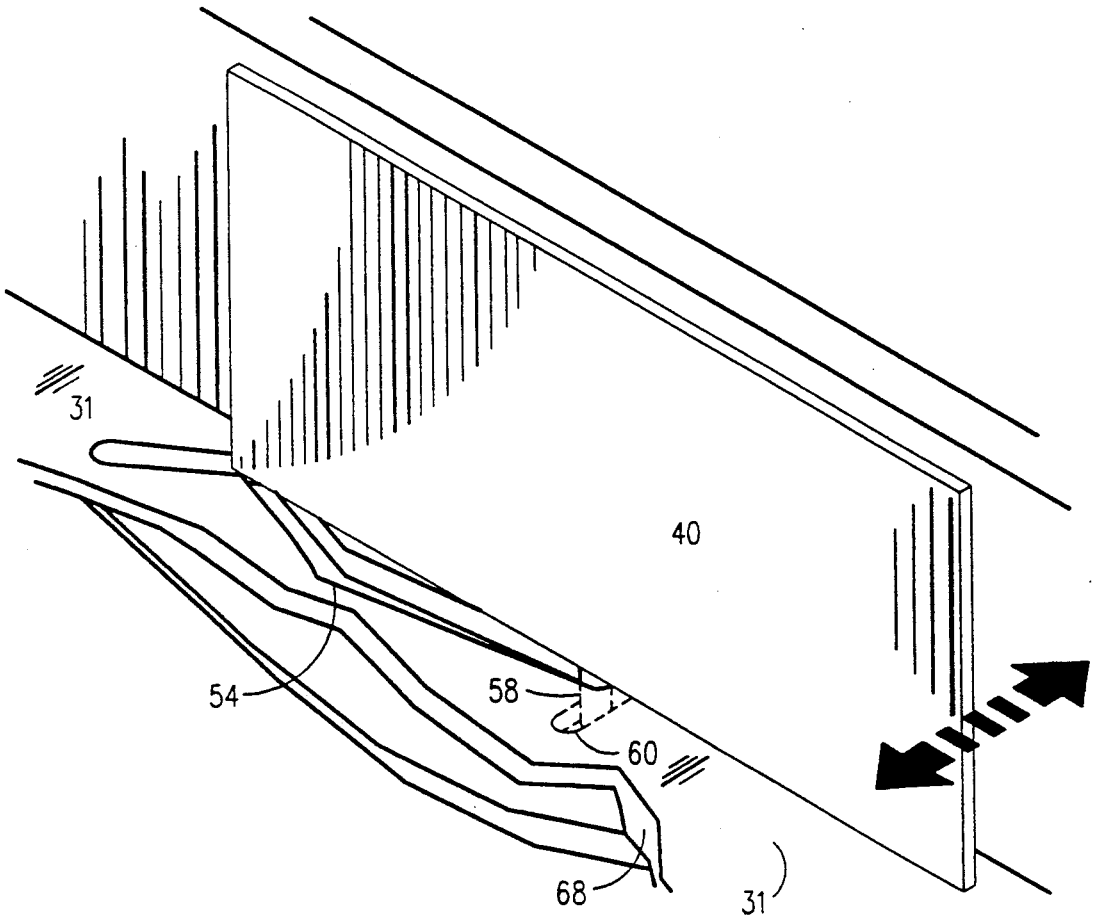

Referring now to the enlarged fragmented views shown in FIGS. 5A and 5B, these views show the contour of the walls 68 of the previously defined slot 53 and they also show the extension of the pin 58 into the orthogonal groove 60 which confines the pin movement in the direction of the paper edge to the contour of the groove 60 as will be appreciated and understood by those skilled in the art. Therefore, the contour of the walls 68 of slot 53 in the paper receiving shelf member 31 represents the mechanical analog or equation for controlling the precise location of the paper width adjustment member 40 with the forward and backward motion of the shelf member 31. Similarly, the contour of the slot 46 in the pivotal cam member 48 defines the mechanical analog or equation for controlling the precise vertical location of the end face 52 at the correct one of the paper length indicia locations on the front wall 20 of the paper cassette 16. This latter movement is also and simultaneously in response to the forward and backward motion of the shelf member 31.

Thus, the present invention provides for the novel and simultaneous paper width dimension control and paper length indication at locations 22 on the front wall 20 of the paper tray 16.

Various modifications may be made in and to the above described embodiments without departing from the spirit and scope of this invention. For example, the present invention is not limited to the four (4) particular paper size settings 22 as noted above, and may include additional paper sizes such as the smaller B5 size memo-type paper. In addition, the present invention is not limited to use specifically with electrophotographic or laser jet printers, and may also be used with ink jet and impact printers and with various types of copiers as well. And, the claims herein are not limited to any particular materials used in the manufacture of the paper cassette, and many different types of metals and plastics may be employed in such manufacture. Accordingly, it is to be understood that these modifications and other obvious variations in the mechanical design and construction of the paper cassette described herein are clearly within the scope of the following appended claims.

I claim:

1. A paper cassette for a printer of the like which includes a front wall having paper size indicia thereon, a movable back wall, a floor member extending between said front and back walls, and cam operated means mechanically coupled between said back wall and said front wall for responding to movement of said back wall for indicating the user the correct paper size on said front wall and for simultaneously electrically indicating to the printer said paper size, and said back wall has a shelf member extending therefrom which is slidably received by said floor member of said cassette, said shelf member having a contoured slot operatively receiving a paper width adjustment member therein which moves said paper width adjustment perpendicularly to the edge of paper loaded into said cassette, said cam operated means includes a cammed shaft member having a predefined contoured slot therein and being pivotally mounted on an upstanding side wall of said cassette, said cammed shaft member having an end face thereof aligned with a plurality of indicia marked openings in said front wall and operative to receive a driver pin in said contoured slot, whereby the horizontal motion of said driver pin in said contoured slot during a paper size setting for said paper cassette will produce a pivotal rotation of said cammed shaft member to thereby move the end face of said cammed shaft member to a desired one of said indicia marked openings to thereby visually indicate the size of paper in the cassette.

2. The paper cassette defined in claim 1 wherein said cammed shaft member includes a wiper blade extending from said end face thereof and operative to provide an electrical indication of the paper size setting within said paper cassette.

3. The paper cassette defined in claim 2 wherein said paper width adjustment member has a pin extending downwardly from its lower facing surface and into said predefined contoured slot in said shelf member, whereby the movement of said slot in said shelf member as said back wall of said cassette is being moved produces a force against said pin extending from said paper width adjustment member to move said paper width adjustment member to a desired width location corresponding to the width of paper being loaded into said cassette.

4. A paper cassette for a printer or copier including in combination:

a. a floor support member adjacent to upstanding side walls and a front wall having a plurality of indicia marked openings therein, b. a back wall slidably received by said floor support member and by said upstanding side walls and being connected to an extended arm having a driver pin projecting therefrom, and c. a cammed shaft member having a predefined contoured slot therein and being pivotally mounted on one of said upstanding side walls, said cammed shaft member having an end face thereof aligned with said plurality of indicia marked openings in said front wall and operative to receive said driver pin in said contoured slot, whereby the horizontal motion of said driver pin in said contoured slot during a paper size setting for said paper cassette will produce a pivotal rotation of said cammed shaft member to thereby move the end face of said cammed shaft member to a desired one of said indicia marked openings to thereby visually indicate the size of paper in the cassette.

5. The paper cassette defined in claim 4 wherein said cammed shaft member includes a wiper blade extending from said end face thereof and operative to provide an electrical indication of the paper size setting within said paper cassette.

6. The paper cassette defined in claim 5 which further includes a shelf member extending from said back wall and receiving thereon an upstanding paper width adjustment member adapted for positioning adjacent the edge of a stack of paper located on said shelf member of said cassette, said paper width adjustment member having a pin extending downwardly from its lower facing surface and into a predefined contoured slot in said shelf member, whereby the movement of said slot in said shelf member as said back wall of said cassette is being moved produces a force against said pin extending from said paper width adjustment member to move said paper width adjustment member to a desired width location corresponding to the width of paper being loaded into said cassette.

7. A paper cassette for a printer or copier including, in combination:

a. a floor support member adjacent to upstanding side wall and a front wall, b. a back wall slidably mounted on said floor support member and having a shelf member extending therefrom with a contoured slot therein, and c. a paper width adjustment member having a pin therein slidably mounted in said slot so that when said shelf member moves inwardly and outwardly on said floor member of said cassette, said paper width adjustment member is moved by the contoured slot in said shelf member to adjust the width of said paper width adjustment member to correspond to the width of the paper within said cassette, and cam operated means mechanically coupled between said back wall and front wall of said cassette and responsive to movement of said back wall to provide a correct indication on said front wall of the paper size being loaded into said cassette, and d. a cammed shaft member having a predefined contoured slot therein and being pivotally mounted on one of said upstanding side walls, said cammed shaft member having an end face thereof aligned with plurality of indicia marked openings in said front wall and operative to receive a driver pin in said contoured slot, whereby the horizontal motion of said driver pin in said contoured slot operates to move the end face of said cammed shaft member to a desired one of said indicia marked openings on said front wall.

8. The paper cassette defined in claim 7 wherein said cammed shaft member includes a wiper blade extending from said end face thereof and being operative to provide an electrical indication of the paper size setting within said paper cassette.

9. The paper cassette defined in claim 8 wherein said indicia marked openings on the front wall of said cassette include a legal paper size opening, an A4 paper size opening, a letter size opening, and an executive paper size opening.

* * * * *